United States Patent [19]

Yamamoto et al.

[11] Patent Number: 4,584,817

[45] Date of Patent: Apr. 29, 1986

[54] CAPSULE SEALING APPARATUS

[75] Inventors: Taizo Yamamoto, Osaka; Hirokazu Konishi, Sakurai, both of Japan

[73] Assignee: Nippon Elanco Kabushiki Kaisha, Osaka, Japan

[21] Appl. No.: 710,384

[22] Filed: Mar. 11, 1985

[30] Foreign Application Priority Data

Mar. 12, 1984 [JP] Japan ..... 59-47771
Sep. 10, 1984 [JP] Japan ..... 59-190247

[51] Int. Cl.[4] ..... B65B 51/02

[52] U.S. Cl. ..... 53/329; 156/69; 156/308.4; 156/308.6

[58] Field of Search ..... 53/416, 471, 476, 484, 53/282, 329, 129, 131; 156/69, 294, 308.6, 308.4

[56] References Cited

U.S. PATENT DOCUMENTS 2,936,493 5/1960 Scherer ..... 53/468 X
3,162,000 12/1964 Kraven ..... 53/471
4,137,117 1/1979 Jones ..... 156/308.6 X
4,384,916 5/1983 Berghahn ..... 156/308.6 X
4,466,844 8/1984 MacLaughlin et al. ..... 156/69
4,522,666 6/1985 Wittwer ..... 156/69

*Primary Examiner*—Horace M. Culver
*Attorney, Agent, or Firm*—Birch, Stewart, Kolasch & Birch

[57] ABSTRACT

A capsule sealing machine comprising a rectifying unit for rectifying closed capsules, which have been supplied from a hopper, so as to assume a predetermined posture, a conveyance unit for conveying from a transfer station, at which the rectified capsules are successively transferred thereto, towards a delivery station, a liquid binder applicator for applying a liquid binder, for example, gelatin solution, to the overlapping joint area between the cap and the body of each of the capsules to provide a tamper-resistant seal, and a drying unit for drying the applied liquid binder.

6 Claims, 19 Drawing Figures

Fig. 3
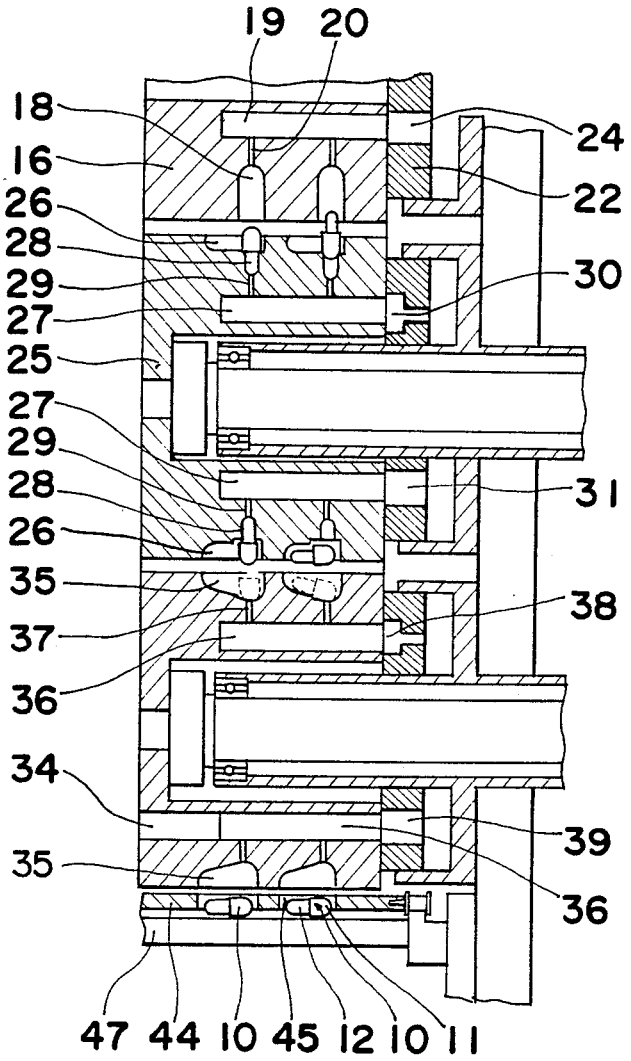
Fig. 4(a)
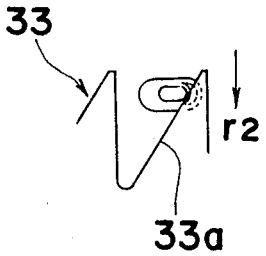
Fig. 4(b)
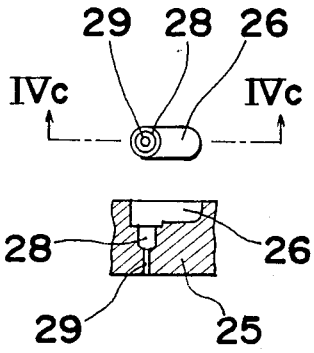
Fig. 4(c)
Fig. 4(d)
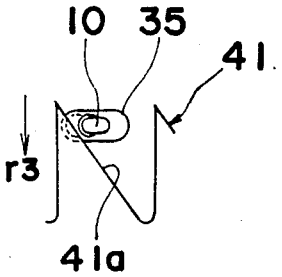
Fig. 4(e)
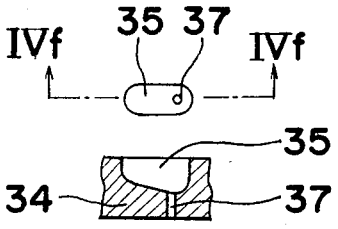
Fig. 4(f)

CAPSULE SEALING APPARATUS

BACKGROUND OF THE INVENTION

The present invention generally relates to the sealing of two-piece capsules to avoid the unauthorized access to, and the leakage of, the sealed contents and, more particularly, to an apparatus for continuously sealing the filled capsules of two-piece construction.

It has long been a general notion that hard-gelatin capsules each made in two sections, cap and body, were to be used exclusively for containing powdery or grainy pharmaceutical product whereas soft-gelatin capsules are used for containing any one of the powdery, grainy and liquid pharmaceutical products. However, attempts to use the hard-gelatin capsules for filling liquid pharmaceutical products have relatively recently been made successfully and pharmaceutical hard-gelatin capsules containing liquid or liquid-containing medicines are currently commercially available along with those containing powdery and grainy ones. This is true not only of the pharmaceutical industry, but also of the food or confectionary industry.

As is well known to those skilled in the art, the closed capsules, i.e., the complete capsules wherein the capsule caps have been mounted on the respective capsule bodies with the contents filled therein, are, before they are packaged in unit number or shipped, sealed for the purpose of avoiding either or both the unauthorized access to the contents and the leak of the contents, particularly if they are liquid, from the closed capsules. Conventionally employed methods for sealing the two-piece capsules include, for example, the employment of what may be possibly termed a "click-on" system wherein each capsule body is formed with either one of a radially outwardly extending circumferential projection and a radially inwardly extending circumferential recess while the respective capsule cap is formed with the other of the circumferential projection and recess so that, when the capsule cap is mounted on the capsule body to provide the complete capsule, the circumferential projection can be clickedly received in the circumferential recess; the application of water to the overlapping joint of each closed capsule to permit the open end of each capsule cap to stick exteriorly to the open end of the respective capsule body upon drying; and the application of a gelatin solution to form a binder layer at the overlapping joint of each closed capsule.

The present invention is essentially concerned with the handling of the two-piece capsules each comprised of a cup-like body and a cap, regardless of the contents filled therein, with a liquid binder such as, for example, a gelatin solution, to provide the fluid-tightly sealed capsules.

A conventional capsule sealing apparatus including a gelatin solution applicator operates on an intermittent basis. In other words, in the conventional apparatus, the closed capsules are intermittently transferred through a binder applying zone where the applicator unit is installed. Accordingly, the conventional apparatus has been found disadvantageous in that the capsule handling capacity is limited with a relatively increased processing time required to complete the sealing of the closed capsules. Moreover, not only does the intermittent transfer system constitute a cause of noise generation, but also the design and nature of the apparatus make it difficult to inspect the successively sealed capsules.

SUMMARY OF THE INVENTION

The present invention has been developed with a view to substantially eliminating the above described disadvantages and inconveniences inherent in the prior art capsule sealing apparatus and has for its essential object to provide an improved capsule sealing apparatus effective to operate on a continuous basis to seal the closed capsules efficiently with increased handling capacity.

Another important object of the present invention is to provide an improved capsule sealing apparatus of the type referred to above, wherein a binder solution is applied to each closed capsule in a few plies to ensure the rigid seal not only against the unauthorized access to the contents in the sealed capsules, but also against the fluid leak from and/or into the sealed capsules.

A further object of the present invention is to provide an improved capsule sealing apparatus of the type referred to above, which can accommodate the varying size of the closed capsules with no machine modification required.

In order to accomplish these objects, the present invention provides a capsule sealing apparatus operable with generally oblong capsules of two-piece construction comprised of capsule bodies and capsule caps closing the openings of the respective capsule bodies with respective overlapping joint defined therebetween. The apparatus herein disclosed comprises, broadly, a capsule rectifying means by which closed capsules successively supplied to such rectifying means can be positioned in a predetermined orientation or posture during the transportation of the closed capsules from a supply station towards a transfer station, a conveyance means including a generally endless slat drivingly trained between generally horizontally spaced drive and driven members for transporting the closed capsules, which have been transferred from the rectifying means at the transfer station in controlled orientation or posture onto the slat, towards a delivery station past a solution applying station, a solution applicator unit including an applicator wheel rotatably supported at the solution applying station for rotation in a plane parallel to the direction of transportation of the closed capsules and generally perpendicular to the longitudinal sense of each of the closed capsules being successively transported for applying a sealing solution to the overlapping joint of each closed capsule, and a drying means installed at a drying zone for drying the sealing solution which has been applied to each closed capsules.

The slat has at least one row of equally spaced, generally oblong openings defined therein so as to extend completely through the thickness thereof in a shape similar to the shape of each closed capsule being handled. These oblong openings are adapted to accommodate the closed capsules for the transportation of the closed capsules from the transfer station towards the delivery station past the solution applying station during the movement of the slat and are arranged in at least one row with the longitudinal sense thereof extending generally perpendicular to the direction of movement of the slat so that, during the transportation of the closed capsules past the solution applying station, the closed capsules can be successively applied with the sealing solution at their overlapping joint then rollingly contacting the applicator wheel. With the slat so constructed, the conveyance means also includes at least one elongated bedplate positioned beneath the slat and extending from the transfer station so as to traverse both the solution applying station and the drying zone. This bedplate is used to support from below the closed capsules received in the respective oblong openings during the transportation of the closed capsules with such capsules rolling in contact therewith.

In order to accommodate the varying length of the closed capsules, each of the oblong openings in the slat is so designed and so sized as to have a length equal to or slightly greater than the maximum possible length of the closed capsule and, on the other hand, the apparatus also comprises a guide means for guiding the closed capsules, during the passage of the closed capsules through the solution applying station so as to align the overlapping joint of each closed capsule with the path of movement o the peripheral face of the applicator wheel. Means may be provided at the solution applying station for increasing the time during which the closed capsules being transported rollingly contacts the peripheral face of the applicator wheel one at a time to permit the respective closed capsule to be rolled a plural number of times.

BRIEF DESCRIPTION OF THE DRAWINGS

These and other objects and features of the present invention will become clear from the following detailed description taken in conjunction with a preferred embodiment with reference to the accompanying drawings, in which:

FIG. 3 is a cross sectional view taken along the line III—III in FIG. 2;

FIG. 4(*a*) is a schematic plan view of a portion of a rectifying drum shown together with a guide strip;

FIG. 4(*b*) is a schematic plan view of a portion of the rectifying drum showing one of the receptacles defined therein;

FIG. 4(*c*) is a cross sectional view taken along the line IVc—IVc in FIG. 4(*b*);

FIG. 4(*d*) is a view similar to FIG. 4(*a*), showing a portion of a transfer drum together with a guide strip;

FIG. 4(*e*) is a schematic plan view of a portion of the transfer drum showing one of the receptacles defined therein;

FIG. 4(*f*) is a cross sectional view taken along the line IVf—IVf in FIG. 4(*e*);

DETAILED DESCRIPTION OF THE EMBODIMENT

Before the description of the present invention proceeds, it is to be noted that like parts are designated by like reference throughout the accompanying drawings.

Figure 8:
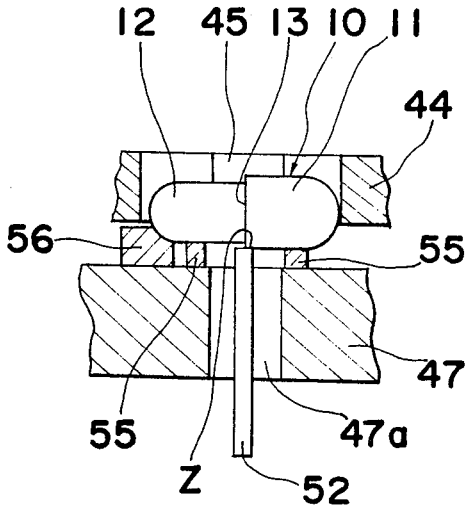
FIG. 8 is a cross sectional view, on an enlarged scale, taken along the line VIII—VIII in FIG. 5.

Referring first to FIG. 8, the type of capsule with which a capsule sealing apparatus embodying the present invention as herein disclosed operates will be described. The illustrated capsule, generally identified by 10, may be referred to as an oblong hard-gelatin capsule in the field of pharmaceutical industry and is comprised of a cylindrical cap 11 and a cylindrical body 12 similar in shape to the cap 11. As is well known to those skilled in the art, after a pharmaceutical product or any other product has been filled in the capsule body 12, the capsule cap 11 is mounted on the capsule body 12 with the open end of the capsule body 12 received in the capsule cap 11 to provide the closed capsule. Thus, the term "closed capsule" hereinbefore and hereinafter used is to be understood as meaning the capsule wherein the cap 11 is mounted on the body 12 in the manner as hereinabove described. It is to be noted that, in the closed capsule 10, an overlapping joint area 13 is formed circumferentially of the closed capsule 10 because of the capsule body 12 received in the capsule cap 11.

Figure 1:
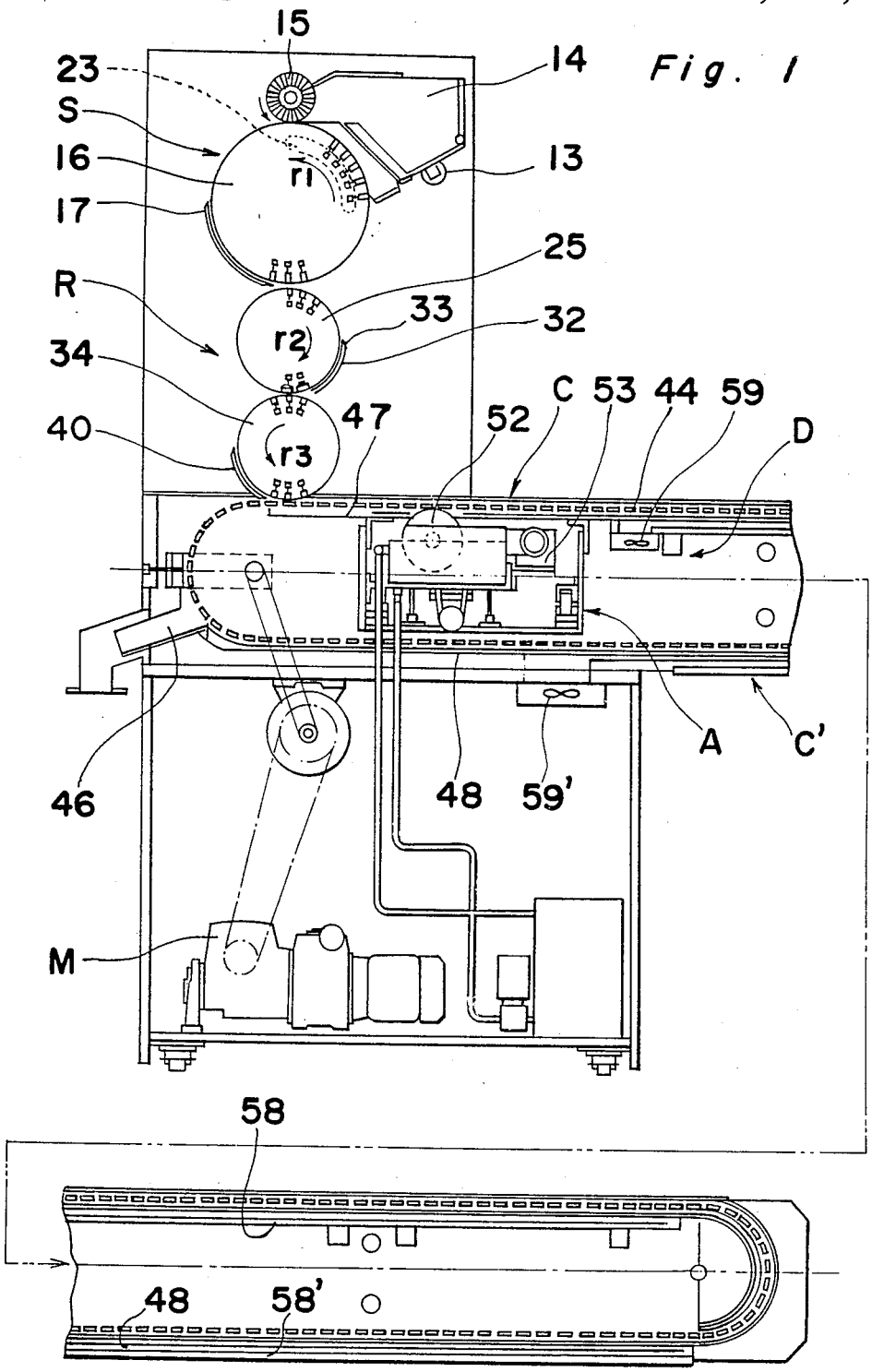
FIG. 1 is a schematic side elevational view showing a capsule sealing apparatus according to the present invention.

Referring now to FIG. 1, the capsule sealing apparatus shown therein generally comprises a capsule supply unit S including a service hopper and a feed drum supported for rotation in one direction as shown by the arrow r1; a capsule rectifying unit R including a rectifying drum, supported below the feed drum for rotation in a direction r2 counter to the direction r1, and a transfer drum supported below the rectifying drum for rotation in a direction r3 counter to the direction r2; a conveyance unit C including a generally endless slat movable in one direction for transporting the closed capsules from a transfer station towards a delivery station; a solution applicator unit A for applying a gelatin solution to each of the closed capsules being transported by the conveyance unit C; and a drying unit D for drying the gelatin solution which has been applied to each closed capsule.

The service hopper is generally identified by 14 and is adapted to accommodate a mass of closed capsules 10 to be handled by the capsule sealing apparatus of the present invention. The hopper 14 may be operatively coupled with a supply chute which may extend from a capsule filing machine (not shown) or any other processing station known to those skilled in the art. So far shown, this hopper 14 is of a generally box-like configuration having a supply opening defined at the bottom thereof with a portion of the outer periphery of the feed drum 16 protruding into the hopper 14 through the supply opening, and is positioned generally above the feed drum 16.

The hopper 14 includes a feed cam assembly 13, operable to avoid any possible formation of bridges of the closed capsules within the hopper 14, and a rotary brush 15 rotatably supported for brushing off from the outer peripheral surface of the feed drum 16 some of the closed capsules 10 which rest on the outer peripheral surface of the feed drum 16 without being received in the pockets 18, as shown in FIG. 1.

Figure 2:
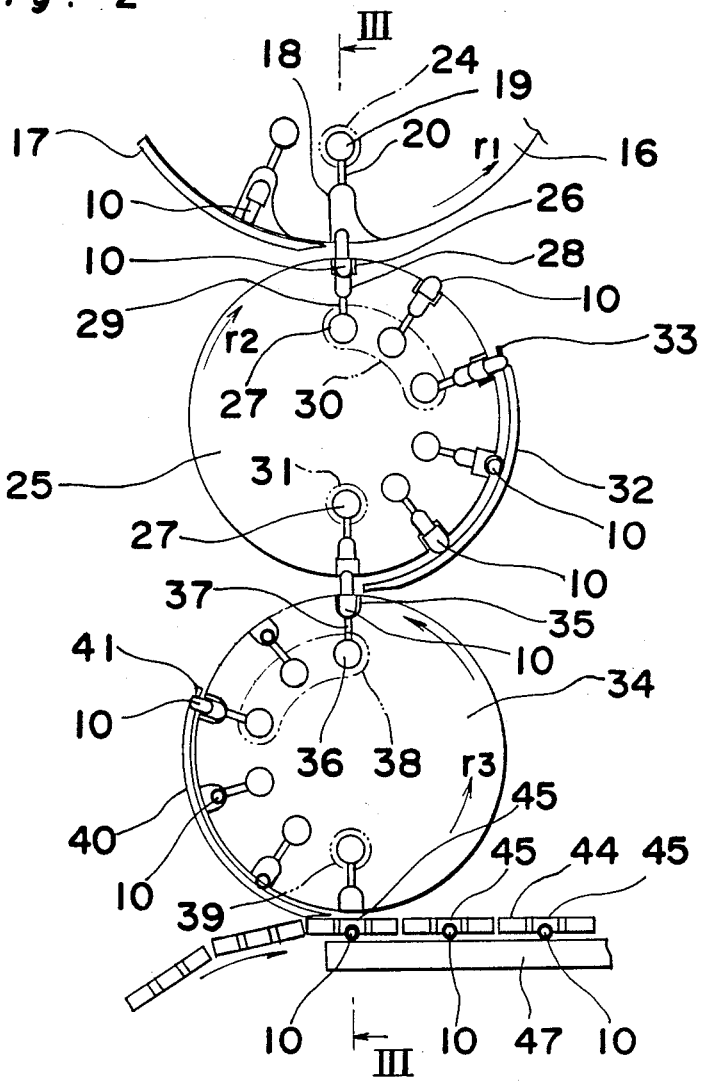
FIG. 2 is a schematic side elevational view, on an enlarges scale, showing a capsule rectifying unit employed in the apparatus.

Referring to FIGS. 1 to 3, the feed drum 16 operable to successively transport the closed capsules 10 from the hopper 14 towards a first relay point during the rotation thereof in the direction r1 has its outer peripheral surface formed with a plurality of, for example, two, circumferential rows of circumferentially equally spaced, radially inwardly extending pockets 18 defined therein, each of said pockets 18 in any one of the rows being so sized and so shaped as to receive the respective closed capsule 10 completely within such pocket 18. This feed drum 16 also has defined therein a plurality of axial passages 19 equal in number to the number of the pockets 18 in each row. While each of said axial passages 19 has one end closed and the other end open at one of the opposite end faces of the feed drum 16 facing a stationary back-up plate 22, the other ends of all of the axial passages 19 are arranged in a circle concentric with the axis of rotation of the feed drum 16. Each pair of the pockets 18, which are located in side-by-side relation with each other with respect to the direction parallel to the axis of rotation of the feed drum 16, are communicated with the respective axial passage 19 through respective radial passages 20 defined in the feed drum 16.

The back-up plate 22, which may be a part of the machine framework, or otherwise be rigidly secured to or mounted on the machine framework, has an arcuate groove, shown by the phantom line 23 in FIG. 1, which is communicated to a source of vacuum (not shown) in any known manner, and a blow hole 24 communicated with a source of compressed air (not shown) in any known manner, both of said groove 23 and said blow hole 24 being defined in the back-up plate 22 at the specific locations which will now be described.

The axial passages 19 in the feed drum 16 can be successively and sequentially communicated to the vacuum source through the arcuate groove 23 and then to the compressed air source through the blow hole 24 during each complete rotation of the feed drum in the direction r1. When some of the axial passages 19 are communicated to the vacuum source through the arcuate groove 23, the closed capsule 10 within the hopper 14 can be sucked into some of the pockets 18 in communication with such some of the axial passages 19 for the transportation towards the first relay point. For this purpose, the arcuate groove 23 is located in alignment with the supply opening in the bottom of the hopper 14 and arcuately extends an angular distance corresponding at least to a fraction of the outer circumference of the feed drum 16 which is accommodated within the hopper 14. On the other hand, the blow hole 24 is located in alignment with the first relay point for ejecting the closed capsules 10, which have been transported successively to the first relay point, from the feed drum 16 and onto the rectifying drum as will be described later.

Although the arcuate groove 23 may extend to a point immediately preceding the blow hole 24 in a direction conforming to the direction r1 of rotation of the feed drum 16, the capsule supply unit S so far shown employs a guard strip 17 curved to follow the curvature of the outer peripheral surface of the feed drum 16 and positioned adjacent the outer peripheral surface of the feed drum 16 so as to extend from the point where each of the closed capsules 10 received in the respective pocket 18 and being transported by the feed drum 16 is ready to be horizontally laid, to the first relay point. This guard strip 17 serves to avoid any possible separation of the closed capsules 10 from the respective pockets 18 during the transportation thereof towards the first relay point and, particularly, when they are downwardly oriented as they approach the first relay point.

It is to be noted that the closed capsules 10 sucked into the respective pockets 18 in the feed drum 16 take their own arbitrary posture, that is, some are received in the pockets 18 with their caps 11 facing the bottoms of the pockets 18 while some are received in the pockets 18 with their bodies 12 facing the outside.

The rectifying drum, generally identified by 25, is rotatably supported immediately below the feed drum 16 for transporting the closed capsules, which have successively been transferred from the feed drum 16 thereto at the first relay point, from the first relay point towards a second relay point. This rectifying drum 25 has its outer peripheral surface formed with two circumferential rows of circumferentially equally spaced, radially inwardly recessed receptacles 26 defined therein, each of said receptacles 26 in any one of the rows being so sized and so shaped as to receive the respective closed capsule 10 in a horizontally laid-down position, i.e., with the longitudinal sense of each closed capsule 10 laying in parallel to the axis of rotation of the rectifying drum 25. The rectifying drum 25 also has defined therein axial passages 27 equal in number to the number of the receptacles 26 in each row. As is the case with the axial passage 19 in the feed drum 16, each of said axial passages 27 has one end closed and the other end open at one of the opposite end faces of the rectifying drum 25 adjacent the back-up plate 22 while the other ends of all of the axial passages 27 are arranged in a circle concentric with the axis of rotation of the rectifying drum 25. Each pair of the receptacles 26, which are located in side-by-side relation with each other with respect to the direction parallel to the axis of rotation of the rectifying drum 25, are communicated with the respective axial passage 27 through sockets 28 and then through radial passages 28 in communication with the sockets 28, both of said sockets 28 and said radial passages 29 being defined in the rectifying drum 25 so as to extend in a direction radially of the rectifying drum 25 between the respective receptacle 26 and the respective axial passage 27. It is to be noted that each of the sockets 28 has a diameter slightly greater than the outer diameter of each capsule body 12, but smaller than the outer diameter of each capsule cap 11 and, accordingly, there will be no possibility that the closed capsule 10 will be received by the rectifying drum 25 with the capsule cap 11 seated completely within the socket 28.

The back-up plate 22 is also formed with an arcuate groove 30, shown by the phantom line in FIG. 2, which groove 30 is communicated with the vacuum source (not shown). The arcuate groove 30 extends a predetermined angular distance from the point in alignment with the first relay point in a direction conforming to the direction r2 of rotation of the rectifying drum 25 so that, when the closed capsules 10 which are successively brought to the first relay point by the rotation of the feed drum 16 are ejected out of the corresponding pockets 18 in the feed drum 16 by a blast of compressed air applied thereto through the axial passages 19 upon successive communication of said axial passage 19 with the compressed air source through the blow hole 24, the ejected capsules 10 can be successively sucked in the associated receptacles 26 in the rectifying drum 25.

So far shown, at a location spaced 180° from the first relay point about the axis of rotation of the rectifying drum 25, a blow hole 31, shown by the phantom line in FIG. 2, is formed in the back-up plate 22 and is communicated to the compressed air source (not shown). This blow hole 31 is operable in a manner substantially similar to the blow hole 24 associated with the feed drum 16, as will be described subsequently in connection with the transfer drum.

Referring to FIGS. 4(*b*) and 4(*c*), each of the receptacles 26 defined in the outer peripheral surface of the rectifying drum 25 has a contour similar to the shape of the closed capsule 10 and has a depth substantially equal to the thickness of the closed capsule 10 or the length of the capsule cap 11, whichever is greater, such that the closed capsule 10 can be received therein in a manner with its longitudinal sense laying in parallel relation to the axis of rotation of the rectifying drum 25. On the other hand, each of the sockets 28 in communication with the respective receptacle 26 has a particular diameter as hereinbefore described and is, accordingly, effective to receive only the body 12 of the closed capsule 10.

In any event, the rectifying drum 25 of the above described construction is so designed and so shaped that, at the first relay point where the minimum spacing is created between the feed and rectifying drums 16 and 25, the closed capsules 10 successively transported thereto by the feed drum 16 are successively sucked into the corresponding receptacles 26 in the rectifying drum 25 upon successive communication of the associated axial passages 27 with the vacuum source through the arcuate groove 30. It is, however, to be noted that, where the closed capsules 10 transported to the first relay point by the feed drum 16 are held in a posture with their caps 11 oriented radially outwardly of the feed drum 16, they can be received in the receptacles 26 in the rectifying drum 25 in the form as extending radially outwardly of the rectifying drum with their caps 11 closing the associated sockets 28 and with their bodies 12 protruding radially outwardly from the outer peripheral surface of the rectifying drum 25, but where the closed capsules so transported to the first relay point are held in a posture with their caps 11 oriented radially inwardly of the feed drum 16, they can be received in the receptacles 26 in the form as extending radially outwardly of the rectifying drum 25 with their bodies 12 sucked completely into the associated sockets 28 and with their caps 11 positioned inwardly of the outer peripheral surface of the rectifying drum 25.

The rectifying unit R also includes a guard strip 32 curved to follow the curvature of the outer-peripheral surface of the rectifying drum 25 and positioned adjacent the outer peripheral surface of the rectifying drum 25 so as to extend from the point, where each of the closed capsules 10 received in the respective receptacle 26 at the first relay point is ready to be downwardly oriented as a result of the rotation of the rectifying drum 25 through a certain angular distance corresponding to the angular distance over which the arcuate groove 30 extends, to the second relay point. One end of the guard strip 32 on the trailing side with respect to the direction of rotation of the rectifying drum 25 is integrally formed, or otherwise rigidly connected, with a rectifying guide member 33 having sloping cam faces 33*a* one for each row of the receptacles 26 as best shown in FIG. 4(*a*).

The function of the sloping cam faces 33*a* of the rectifying guide member 33 is to lay down some of the closed capsules 10, which are successively transported by the rectifying drum 25 from the first relay point towards the second relay point with their bodies 12 projecting outwardly from the peripheral surface of the rectifying drum 25, in sliding contact with the sloping cam faces 33. In other words, the sloping cam faces 33*a* act only on the closed capsules 10 which are, during the transportation from the first relay point towards the second relay point carried by the rectifying drum 25, received in the respective receptacles 26 with their bodies 12 projecting radially outwardly from the outer peripheral surface of the rectifying drum 25, so as to lay them down within such respective receptacles 26 to render them to extend generally in parallel relation to the axis of rotation of the rectifying drum 25.

It is to be noted that one end of the arcuate groove 30 remote from the first relay point and on the leading side with respect to the direction of rotation of the rectifying drum 25 is positioned in alignment with the rectifying guide member 33, so that, substantially simultaneously with or immediately after the engagement of the closed capsules, whose bodies protrude outwardly from the outer peripheral surface of the rectifying drum 25, with the associated sloping cam faces 33*a*, the communication between the associated axial passages 27 with the vacuum source through the arcuate groove 30 can be interrupted.

As is the case with the guard strip 17 associated with the feed drum 16, the guard strip 32 on the leading side of the rectifying guide member 33 with respect to the direction r2 of rotation of the drum 25 acts to avoid any possible separation of the closed capsules 10 from the respective receptacles 26 and/or the sockets 28 during the transportation thereof towards the second relay point.

The transfer drum, generally identified by 34, is similar in construction to the rectifying drum 25 and has its outer peripheral surface formed with two circumferential rows of circumferentially equally spaced, radially inwardly recessed receptacles 35 each having a contour similar to the shape of the closed capsule 10. This transfer drum 34 is rotatably supported immediately below the rectifying drum 25 for transporting the closed capsules, which have successively been transferred from the rectifying drum 25 thereto at the second relay point, from the second relay point towards a transfer station. Each of the receptacles 35 in any one of the rows is so sized and so shaped as to receive the respective closed capsule 10 in horizontally laid-down position.

Each pair of the receptacles 35 in the two rows are selectively communicateable with the vacuum source and then with the compressed air source and, for this purpose, the transfer drum 34 has defined therein axial passages 36 equal in number to the number of the receptacles 35 in each row. Each of these axial passages 36 has one end closed and the other end open at one of the opposite end faces of the transfer drum 34 adjacent the back-up plate 22 while the other ends of said axial passages 36 are arranged in a circle concentric with the axis of rotation of the transfer drum 34. Each pair of the receptacles 35, which are located in side-by-side relation with each other with respect to the direction parallel to the axis of rotation of the transfer drum 34, are communicated with the respective axial passage 36 through radial passages 37 defined in the transfer drum 34 so as to extend in a direction radially of the transfer drum 34 between the respective axial passage 36 and the associated receptacles 35.

For selectively communicating some of the axial passages 36 with the vacuum source and then with the compressed air source, an arcuate groove 38 in communication with the vacuum source and a blow hole 39 in communication with the compressed air source are defined in the back-up plate 22 as best shown in FIGS. 2 and 3, in alignment with the path of travel of any one of the other ends of the axial passages 36. The arcuate groove 38 extends a predetermined angular distance from the point in alignment with the second relay point in a direction conforming to the direction r3 of rotation of the transfer drum 34 so that, when the closed capsules 10 successively brought to the second relay point by the rotation of the rectifying drum 25 are ejected out of the corresponding receptacles 26 and/or the corresponding sockets 28 in the rectifying drum 25 by a blast of compressed air applied thereto through the axial passages 27 upon successive communication of said axial passage 27 with the compressed air source through the blow hole 31, the ejected capsules can be successively sucked in the associated receptacles 35 in the transfer drum 34. The closed capsules 10 carried by and successively transported by the transfer drum 34 to the transfer position can be successively ejected from the corresponding receptacles 35 by a blast of compressed air applied thereto through the respective axial passages 36 upon successive communication of said axial passages 36 with the compressed air source through the blow hole 39.

Referring particularly to FIG. 3, some of the closed capsules 10 carried by the rectifying drum 25 and approaching the second relay point after having past the rectifying guide member 33 are supported with their bodies 12 received within the corresponding sockets 28 in the rectifying drum 25 and some others are supported in horizontally laid-down position within the corresponding receptacles 26. While the closed capsules 10 transported to the second relay point in horizontally laid-down position within the corresponding receptacles 26 are, at the second relay point, ejected from the rectifying drum 25 onto the transfer drum 34 and subsequently received in the associated receptacles 35 in horizontally laid-down position, the closed capsules 10 transported to the second relay point with their bodies 12 received in the corresponding sockets 28 are at the second relay point, ejected from the rectifying drum 25 onto the transfer drum 34 and subsequently received in the associated receptacles 35 with their bodies 12 protruding radially outwardly from the outer peripheral surface of the transfer drum 34 and with their caps 11 closing the radial passages 37.

However, since a guard strip 40 having a rectifying guide member 41, which is similar in construction to, and functions in a manner similar to, the guard strip 32 associated with the rectifying drum 25, is employed and arranged adjacent the outer peripheral surface of the transfer drum 34, some of the closed capsules 10 which are received in the corresponding receptacles 35 in the form as extending radially outwardly of the transfer drum 34 with their bodies 12 situated exteriorly of the receptacles 35 can be laid down as they successively contact sloping cam faces 41*a* of the rectifying guide member 41, as best shown in FIG. 4(*d*), during the rotation of the transfer drum 34. It should be noted that, while the guard strip 40 having the rectifying guide member 41 is arranged adjacent the transfer drum 34, and is also operable, in a manner similar to the guard strip 32 having the rectifying guide member 33 which is arranged adjacent the rectifying drum 25, the guard strip 40 is positioned on one side opposite to the guard strip 32 with respect to the imaginary line passing through the axes of the rotation of the respective drums 25 and 34 because of the difference in direction of rotation.

FIGS. 4(*e*) and 4(*f*) illustrate the top plan and sectional view of any one of the receptacles 35 defined in the transfer drum 34, respectively. It will readily be seen that, except that no pocket such as employed in the rectifying drum 25 is employed in the transfer drum 34, the transfer drum 34 and its related component parts are substantially identical with the rectifying drum 25 and its relates component parts.

From the foregoing description, it has now become clear that the closed capsules 10 transported successively in random-oriented position from the hopper 14 are rectified so as to assume a predetermined orientation or posture. More specifically, as can be understood from the bottom region of FIG. 3, all of the closed capsules 10 successively transported to the transfer station in the manner as hereinbefore described are held in laid-down position with their caps 12 oriented in the same direction.

From the transfer station towards a delivery station, the rectified capsules 10 transferred successively from the transfer drum 34 can be transported by the conveyance unit C. During the transportation towards the delivery station, the rectified capsules 10 are successively passed through a solution applying zone at which a liquid binder, for example, a gelatin solution, is applied to the overlapping joint area 13 of each of the rectified capsules 10, and then through a drying zone where the applied solution is dried to provide the completely sealed capsules.

The generally endless slat forming a part of the conveyance unit C is generally identified by 44. This slat 44 extends horizontally and trained between drive and driven members (not shown), said drive member being positioned generally beneath the transfer drum 34 and adjacent the transfer station and drivingly coupled with a drive motor M so that, during the rotation of the drive motor M, the slat 44 can be moved in one direction over the drive and driven members. The slat 44 so trained between the drive and driven members has a upper run and a lower run beneath the upper run and also has parallel rows of oblong openings 45 defined therein in equally spaced relation to each other over the entire circumference thereof, the number of said parallel rows of oblong openings 45 being equal to the number of the rows of the receptacles 35 in the transfer drum 34. This slat 44 is so positioned relative to the transfer drum 34 that the rows of the receptacles 35 in the transfer drum 34 can exactly align with the respective rows of the oblong openings 45 in the upper run of the slat 44 so that the closed capsules, which are successively ejected from the receptacles 35 in the transfer drum 34 at the transfer station as a result of the communication between the associated axial passages 36 and the compressed air source through the blow hole 39, can fall by gravity onto the respective oblong openings 45 in the slat 44 as shown in FIG. 3.

Although the delivery station at which the completely sealed capsules 10 are discharged from the conveyance unit C for the subsequent processing, for example, packaging, may be provided at a location opposite to the transfer station and adjacent one end of the upper run of the slat 44 remote from the transfer station, the delivery station in the illustrated embodiment is located generally beneath the transfer drum 34 and adjacent one of the opposite ends of the lower run of the slat 44 adjacent the transfer station as represented by a discharge chute 46. Hence, the closed capsules 10 received in the oblong openings 45 travel, as the slat 44 is driven in one direction, from the transfer station towards the delivery station having been turned around the driven member.

For supporting the capsules 10 within the oblong openings 45 from below, an upper back-up plate 47 and a lower back-up plate 48 are disposed immediately below the upper and lower runs of the slat 44, respectively, and are fixedly supported in position by the machine framework so as to extend in parallel relation to the associated upper and lower runs of the slat 44. Specifically, at the location remote from the transfer station and adjacent the driven member, the upper back-up plate 47 has one end curved inwardly of the slat 44 to follow the curvature of the driven member defining a turning area of the slat 44 between the upper and lower runs, while one end of the lower back-up plate 48 adjacent the curved end of the upper back-up plate 47 is correspondingly curved outwardly of the slat 44 to follow the curvature of the driven member. It will, accordingly, be understood that the capsules 10 being transported by the slat 44 are held between the curved ends of the respective upper and lower backup plates 47 and 48 as they successively turn around the driven member. It is to be noted that the other end of the lower back-up plate 48 remote from the turning area of the slat 44 is continued to the discharge chute 46 so that the completely sealed capsules 10 successively transported to the delivery station can be smoothly delivered onto the discharge chute 46. It is also to be noted that, during the transportation of the capsules 10 from the transfer station towards the delivery station while received in the respective oblong openings 45 in the slat 44, the capsules 10 roll about their own axis in contact with the upper back-up plate 47 and the lower back-up plate 48.

Figure 7:
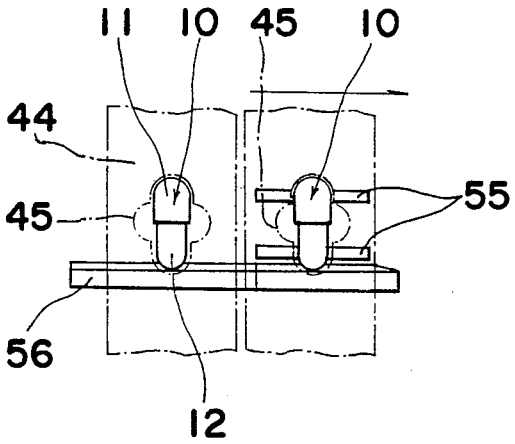
FIG. 7 is a top plan view of a portion of a slat showing a positioning guide employed in the apparatus.

Referring now to FIG. 7, each of the oblong openings 45, shown by the phantom line, in any one of the rows in the slat 44 has a maximum length slightly greater than the maximum length of each capsule 10 and has a substantially intermediate portion thereof enlarged to a width greater than the thickness of each capsule 10.

Referring particularly to FIGS. 1, 5, 8 and 9, the solution applicator unit A is arranged between the upper and lower runs of the slat 44 and positioned a distance from the transfer station in a direction downstream of the direction of travel of the capsules 10. This applicator unit A comprises a solution bath 50 containing a predetermined quantity of liquid binder, for example, gelatin solution 51, and a rotary wheel comprised of coaxial discs 52 equal in number to the number of the row of the oblong openings 45 in the slat 44. The rotary discs 52 are coaxially supported for rotation in a direction counter to the direction of movement of the capsules 10 from the transfer station towards the delivery station with their lower regions constantly immersed in the gelatin solution 51 and with their upper regions protruding loosely upwardly through slots 47*a* defined in the upper back-up plate 47 in alignment with the rows of the oblong openings 45. The rotary discs 52 are spaced such a distance that the overlapping joint areas of the capsules received in the respective rows of the oblong openings 45 can contact the respective peripheral faces of the rotary discs 52 as they successively travel through the solution applying zone.

The rotary discs 52 adapted to be driven by a motor 53 are, during the rotation in one direction, immersed in the gelatin solution 51 and carries it upwards. Accordingly, as the capsules 10 in the rows of the oblong openings 45 successively pass over the associated slots 47*a* in the upper back-up plate 47, the peripheral faces of the respective rotary discs 52 contact the capsules 10 to apply the gelatin solution to the overlapping joint areas 13 of the capsules 10 in a manner as best shown in FIG. 8. At this time, the capsules 10 being applied with the gelatin solution are rotated about their own longitudinal axis in contact with the rotary discs 52 in a direction counter to the direction of rotation of the rotary discs 51.

Figure 5:
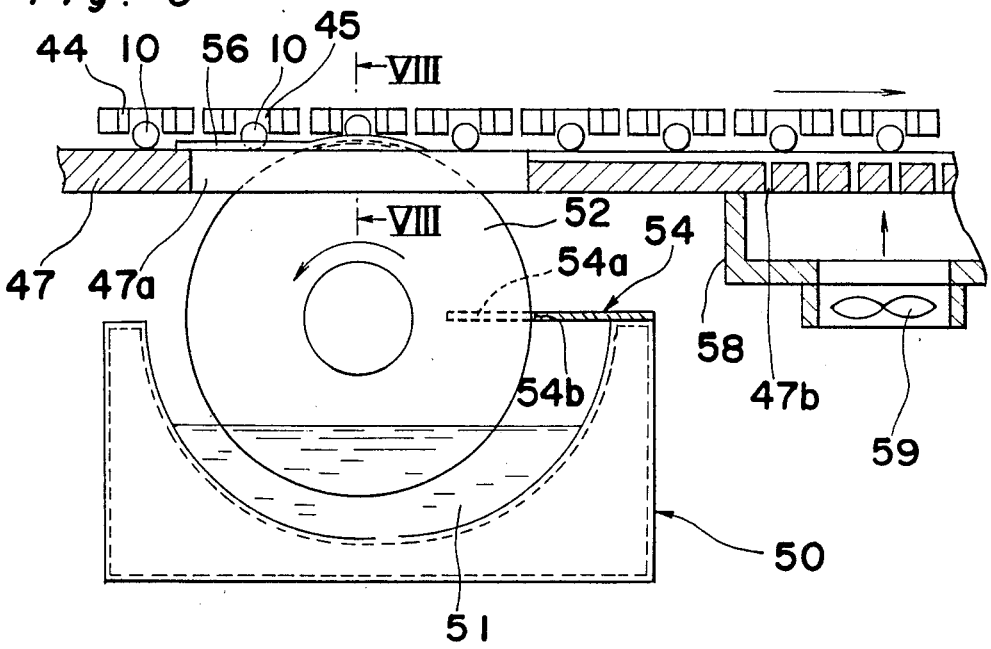
FIG. 5 is a side view, on an enlarged scale, showing a solution applicator unit employed in the apparatus.
Figure 9:
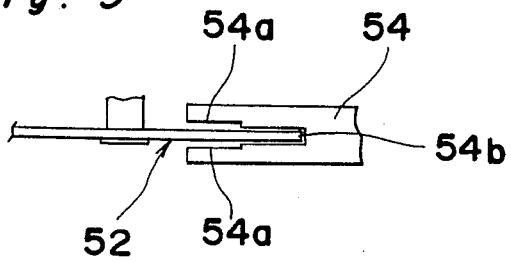
FIG. 9 is a schematic top plan view of a portion of the applicator wheel shown in relation with a scraper.
Figure 10:
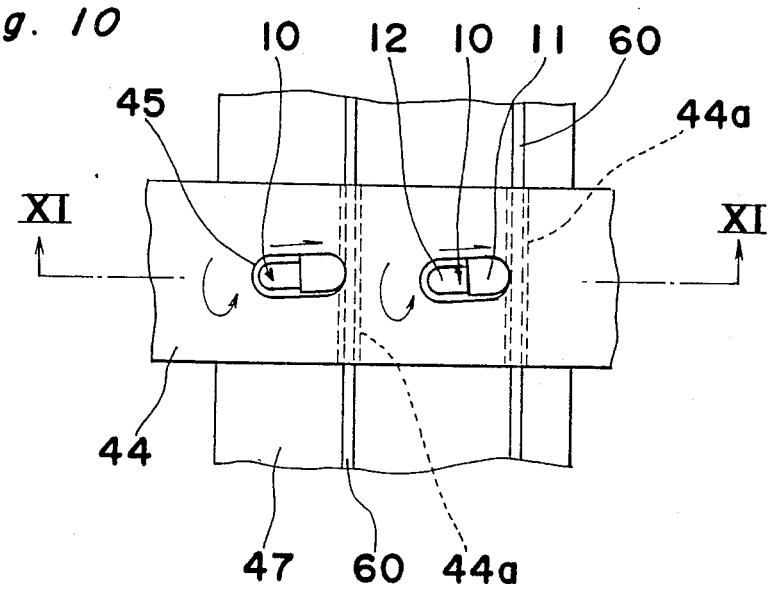
FIG. 10 is a top plan view of the slat showing a modified form of the positioning guide.
Figure 11:
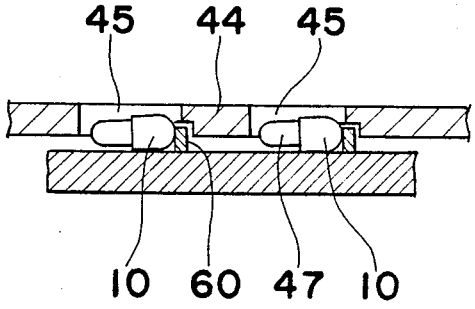
FIG. 11 is a cross sectional view taken along the line XI—XI in FIG. 10.

In order to ensure that the quantity of the gelatin solution applied to the capsules 10 is uniform or substantially uniform at all times, a generally U-shaped scraper member 54 having a pair of arms 54*a* is employed for each of the rotary discs 52 as shown in FIGS. 5 and 9. The scraper member 54 for each of the rotary discs 52 is fixedly supported with a peripheral area of the respective rotary disc 52 received in the generally U-shaped recess between the arms 54*a*. In this arrangement, the arms 54*a* are held in sliding contact with the opposite surfaces of the respective rotary disc 52 for the purpose of removing the gelatin solution adhering to such opposite surfaces of the respective rotary disc 52 while a portion 54*b* of the scraper member 54 corresponding to the bottom of the shape of a figure "U" is spaced from the peripheral face of the respective rotary disc 52 a predetermined distance required to remove the excessive gelatin solution so that a controlled quantity of gelatin solution can be applied to the overlapping joint area 13 of each of the closed capsules 10 at the solution applying zone.

Figure 6:
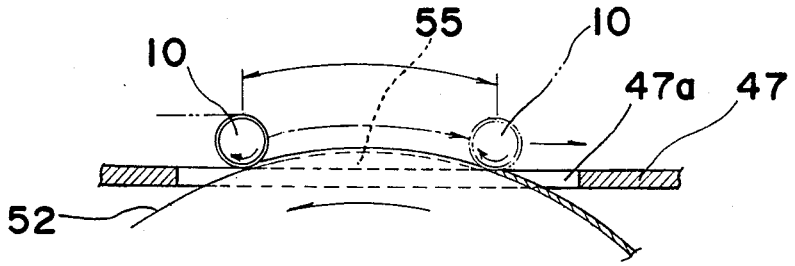
FIG. 6 is a side view, on a further enlarges scale, of a portion of the solution applicator unit showing how each closed capsule contacts an applicator wheel.

Referring to FIG. 6, during the travel of each of the closed capsules 10 from the point where it is brought into contact with the associated rotary disc 52 to the point where it disengages from such rotary disc 52 after having applied with the gelatin solution, the respective closed capsule 10 is rotated a number of revolutions in contact with the rotary disc 52 being rotated so that the gelatin solution can be applied in a number of plies. The number of revolutions of the respective closed capsule 10 can be controlled by controlling the speed of rotation of the rotary disc 52. The higher the speed of rotation of the rotary disc 52, the greater the number of revolution of the closed capsule 10 and, hence, the greater the number of plies of the gelatin solution applied to the capsule 10.

However, in the present invention, in order to render each closed capsule 10 to undergo at least three complete rotations about its own longitudinal axis during the travel through the solution applying zone in contact with the outer peripheral face of the associated rotary disc 52, a pair of arcuate guide members 55 are rigidly mounted on the upper back-up plate 47 on respective sides of each slot 47*a* as shown in FIGS. 6 to 8 so that the path of travel of the closed capsule 10 through the solution applying zone can be substantially increased with the consequently increased period of time during which the capsule 10 maintains its contact with the outer peripheral face of the associated rotary disc 52. These arcuate guide members 55 are of identical structure and are curved to follow the curvature of the outer peripheral face of the associated rotary disc 52.

In order to ensure that the overlapping joint area 13 of each of the closed capsules 10 can be exactly aligned with the associated rotary disc 52 during the application of the gelatin solution thereto even though each of the oblong openings 45 has a length slightly greater than the length of the respective closed capsule 10 as hereinbefore described, that is, even though the closed capsule 10 is permitted to slightly move lengthwise within the respective oblong opening 45, a positioning guide in the form of a biasing guide bar 56 for each row of the oblong openings 45 is rigidly mounted on the upper back-up plate 47 on one side of the associated slot 47*a* and extends from a point a certain distance preceding from the point where the closed capsule is brought into contact with the associated rotary disc 52 in readiness for the application of the gelatin solution thereto, terminating at the point where the closed capsule 10 after having been applied with the gelatin solution separate away from the associated rotary disc 52, as shown in FIGS. 5, 7 and 8. It is to be noted that one of the opposite ends of the biasing guide bar 56 adjacent the paired arcuate guide members 55 is raised to follow the curvature of any one of the arcuate guide members 55 so that, even during the travel of each closed capsule 10 over the arcuate guide members 55, it can be urged in one direction lengthwise thereof in contact with the biasing guide bar 56.

It will readily be seen that, as the capsules 10 transported by the slat 44 successively approach the solution applying zone, one of the opposite ends of each of the capsules, for example, the capsule body 12, slidingly contacts the biasing guide bar 56 and, consequently, the respective capsule 10 is urged in one direction lengthwise thereof in contact with the biasing guide bar 56 wherefor such capsule 10 is refrained from undergoing an arbitrary displacement within the associated oblong opening 45 as best shown in FIG. 8.

The gelatin solution used to seal the closed capsules may contain a coloring agent if desired. In any event, the gelatin solution within the bath 50 is kept at a predetermined temperature, for example, 40 to 50° C. and, for this purpose, the bath 50 may have a hot water jacket through which hot water can circulate to warm the gelatin solution. Alternatively, the bath 50 may have a built-in heater.

After the solution applying zone, the capsules applied with the gelatin solution are successively transported through the drying zone where the drying unit D is installed.

Referring to FIGS. 1 and 5, the drying unit D comprises a generally U-sectioned trough 58 secured to the upper back-up plate 47 from below and extending from a location adjacent the applicator unit A to a location adjacent the turning area of the slat 44. A portion of the upper back-up plate 47 which is covered by the trough 58 is formed with a row of perforations 47*b* for each row of the oblong openings 45, through which perforations 47*b* hot air flowing within the trough 58 can emerge outwards for drying the plies of gelatin solution applied to the capsules 10 being transported by the slat 44. The hot air originates from a heater (not shown) and is introduced into the trough 58 by a blower fan 59.

A similar drying unit C′ including a trough 58′ and a blower fan 59′ is provided for drying the capsules 10 then transported by the lower run of the slat 44, with the trough 58′ secured to the lower back-up plate 48 from below. As is the case with the upper back-up plate 47, a portion of the lower back-up plate 48 which is covered by the trough 58′ is perforated for the admission of hot air from the interior of the trough 58′ towards the capsules being transported by the lower run of the slat 44. It is to be noted that the provision of the drying unit C′ may not be always essential.

In the foregoing description, the positioning guide has been described as employed in the form of the biasing guide bar 56. However, in the example shown in FIGS. 10 to 14, the positioning guide is employed in the form of a stopper bar 60 and, on the other hand, each of the oblong openings 45 in the slat 44 is so defined therein as to incline a predetermined angle relative to the widthwise direction of the slat 44 or the imaginary line at right angles to the direction of movement of the slat 44.

Figure 12:
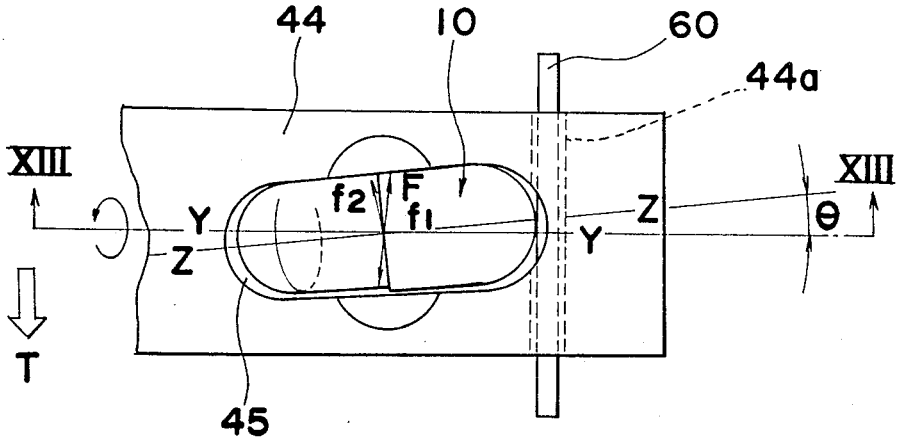
FIG. 12 is a top plan view, on a further enlarged scale, of a portion of the slat showing a modified form of one of the openings defined in the slat.
Figure 13:
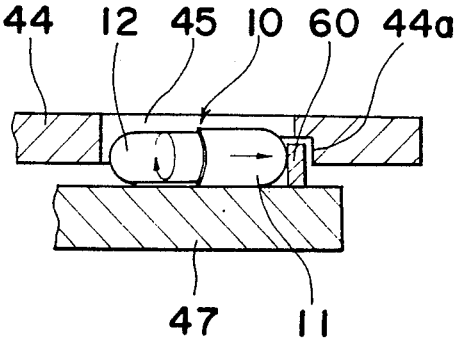
FIG. 13 is a cross-sectional view taken along the line XIII—XIII in FIG. 12.
Figure 14:
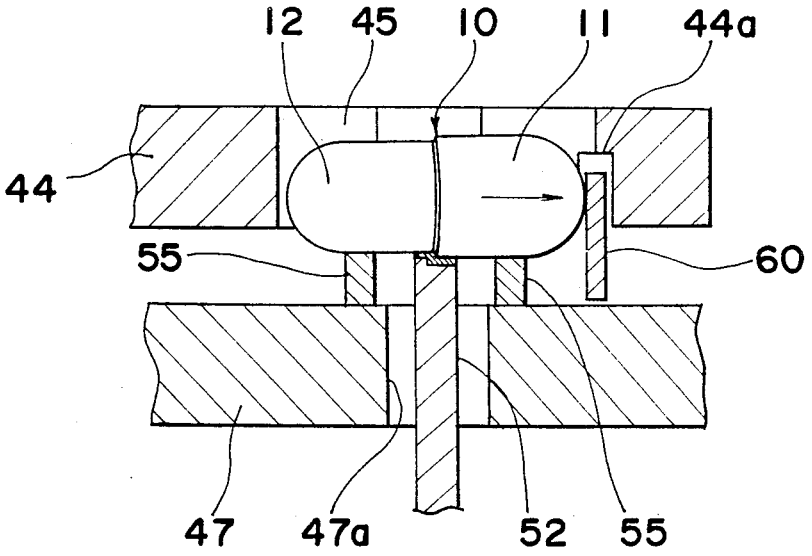
FIG. 14 is a view similar to FIG. 8, showing the modified form of the positioning guide.

Referring now to FIGS. 10 to 14, and particularly to FIG. 12, each of the oblong openings 45 in any one of the rows is so defined in the slat 44 as to have its longitudinal axis Z—Z inclined at a predetermined angle $\theta$ relative to the axis Y—Y representing the widthwise direction of the slat 44, which axis Y—Y is at right angles to the direction T of movement of the slat 44. The angle $\theta$ of inclination of the respective oblong opening 45 depends on the design and shape of the closed capsules 10 (either tapered or stepped) and, however, it is desirable to be within the range of 0.5° to 45° and, preferably, 1° to 15°.

For each row of the oblong openings 45 in the slat 44, the slat 44 has a guide groove 44*a* defined in the undersurface thereof over the entire circumference thereof, said guide groove 44*a* being partially communicated with one of the opposite ends of each oblong opening 45 in the respective row. As a matter of design the guide grooves 44 employed for all of the rows of the oblong openings 45 are equally spaced from each other over the entire circumference of the slat 44.

In register with the respective guide groove 44*a* defined in the undersurface of the slat 44, the stopper bar 60 for each row of the oblong openings 45 is adjustably mounted on the upper back-up plate 47 so as to extend over the solution applying zone. The stopper bar 60 is adjustably movable in a direction widewise of the slat 44 or the back-up plate 47 for accommodating the varying length of the capsules 10 to be handled by the capsule sealing apparatus according to the present invention. It is to be noted that, since during the movement of the slat 44, each stopper bar 60 is slidingly received in the respective guide groove 44*a*, the respective guide groove 44*a* should have a width so selected as to permit the adjustable movement of the stopper bar 60 in the direction widthwise of the slat 44.

In the example shown in and described with reference to FIGS. 10 to 14, the exact alignment with each closed capsule 10 with the rotary applicator disc 52 can be achieved by the following reason. Assuming that the respective closed capsule 10 loosely accommodated within the associated oblong opening 45 while being transported by the slat 44 undergoes its rolling motion about its own longitudinal axis in frictional contact with the upper back-up plate 47 while approaching one of the opposite ends of the associated stopper bar 60 upstream of the solution applying zone with respect to the direction T of movement of the slat 44, a force F shown in FIG. 12 acts on the closed capsule 10 exerting components f1 and f2 with which the capsule 10 can be urged in one direction axially of the capsule 10 towards the associated stopper bar 60 because of the inclined feature of each of the oblong openings 45. As soon as the respective capsule 10 enters the solution applying zone, the capsule 10 so urged contacts the associated stopper bar 60 and, accordingly, any arbitrary displacement of the capsule within the associated oblong opening 45 is refrained. On the other hand, the stopper bar 60 is, at the outset of operation of the machine, adjusted to such a position that each capsule 10 so urged with one end thereof slidingly contacting the stopper bar 60 can have its overlapping joint area 13 aligned with the outer peripheral face of the applicator disc 52.

It is to be noted that the greater the angle $\theta$ of inclination of each oblong opening 45, the smaller the distance over which the associated capsule 10 displaces before one end thereof contacts the stopper bar 60. Conversely, the smaller the angle $\theta$ of inclination, the greater the distance of displacement of the associated capsule within the respective oblong opening 45.

While the capsule sealing apparatus according to the present invention is constructed as hereinbefore described, it operated in the following manner.

Assuming that a mass of closed capsules are accommodated within the hopper 14 and all of the drums 16, 25 and 34 as well as the motors M and 53 are driven, some of the closed capsules 10 within the hopper 14 are successively sucked and received in the pockets 18 in the feed drum 16 in an arbitrary posture as said drum 16 passes through the hopper 14, by the reason which has been described hereinbefore. The closed capsules 10 so received in the pockets 18 are transported to the first relay point at which the axial passages 19 are successively communicated to the compressed air source and, therefore, the closed capsules are successively ejected onto the rectifying drum 25.

The closed capsules 10 ejected onto the rectifying drum 25 at the first relay point are sucked partly in the receptacles 26 and partly in the pockets 28. As hereinbefore described, some of the closed capsules 10 sucked in the receptacles 26 have their bodies 12 protruding radially outwardly from the outer peripheral surface of the rectifying drum 25 whereas some of the capsules 10 sucked in the sockets 28, although they are held in position extending radially, have their bodies 12 positioned inwardly of the outer peripheral surface of the rectifying drum 25. As the rectifying drum 25 rotates in the direction r2, some of the capsules 10 having their bodies 12 radially outwardly extending from the outer peripheral surface of the rectifying drum 25 are laid down within the associated receptacles 36 by the action of the rectifying guide member 33 in the manner as hereinbefore described. As they arrive at the second relay point during the continued rotation of the rectifying drum 25, the capsules 10 are ejected by the blow of compressed air onto the transfer drum 34. At this time, some of the capsules 10 having their bodies 12 received in the socket 28 are received in the receptacles 35 with their bodies 12 protruding radially outwardly from the outer peripheral surface of the transfer drum 34, whereas some of the capsules 10 which have been laid down are received in the receptacles 35 in laid-down posture.

The capsules 10 transferred at the second relay point onto the transfer drum 34 are transported towards the transfer station. During the transportation towards the transfer station, some of the capsules 10 having their bodies 12 protruding radially outwardly from the outer peripheral surface of the transfer drum 34 are laid down within the receptacles 35 by the action of the rectifying guide member 41 in the manner as hereinbefore described. Thus, at the time the capsules 10 being transported by the transfer drum 34 arrive at the transfer station, all of the capsules 10 so transported are held in laid-down posture with the caps 11 of all of them oriented in the same direction.

The closed capsules 10 which have been successively rectified in the manner as hereinabove described are successively ejected onto the generally endless slat 44 moving in one direction immediately below the transfer drum 34 as best shown in FIGS. 2 and 3.

The closed capsules 10 are then transported from the transfer station towards the delivery station past the solution applying zone and the drying one by means of the generally endless slat 44. During the transportation, the capsules may, or may not, roll in contact with the back-up plates 47 and 48. However, as they approach the solution applying zone, they can be positively rolled about their own longitudinal axis in contact with the rotary applicator discs 52 in a direction counter to the direction of rotation of the applicator discs 52. The rolling motion of the capsules 10 continues until the capsules leave from the solution applying zone, during which the gelatin solution is applied to the capsules 10 at their overlapping joint areas 13. It is to be noted that, during the passage of the capsules through the solution applying zone, the capsules 10 move with their overlapping joint areas 13 successively aligned with the associated applicator discs 52 by the reason as hereinbefore described with particular reference to FIGS. 6 to 8 or to FIGS. 10 to 14.

After the application of the gelatin solution, the gelatin solution applied to the overlapping areas 13 of the respective capsules 10 are dried by the drying unit D as they pass through the drying zone to provide the completely sealed capsules. The sealed capsules 10 are then discharged from the slat 44 onto the discharge chute 46.

From the foregoing full description of the present invention, it has now become clear that, because of the provision of the paired arcuate guide members mounted on the upper back-up plate at the solution applying zone, the time during which each capsule contacts the applicator disc can advantageously prolonged and, at the same time, each capsule can be forced to roll in a number of revolutions in contact with the applicator disc. This is particularly advantageous in that, for a given distance over which the capsules travel, the gelatin solution can be assuredly applied in a number of times to the overlapping joint area of each of the capsules. Plural plies of gelatin solution thus applied provide a rigid and tamper-resistant seal effective to prevent the capsules from being tampered and/or to prevent the contents of each capsule from leaking.

Moreover, it is also clear that the machine according to the present invention performs a capsule sealing method comprising capsule rectification, capsule transportation past the solution applying zone, the capsule transportation past the drying station, and application of the gelatin solution, all of these process steps being continuously and successively performed. Accordingly, the sealing of the closed capsules can effectively be carried out in a relatively short handling time.

Furthermore, during the passage of the sealed capsules through the drying zone, the capsules can readily be inspected to find the presence of some defective capsules.

Although the present invention has fully been described in connection with the preferred embodiment thereof with reference to the accompanying drawings, it is to be noted that various changes and modifications are apparent to those skilled in the art. By way of example, the type of capsules with which the machine of the present invention operates is not always limited to the hard-gelatin capsule, but it may be an enteric capsule made of cellulose derivative.

Moreover, the capsule supply unit and the capsule rectifying unit may be of any known construction such as disclosed in, for example, Japanese Pat. No. 53-12239 published in 1978.

Accordingly, such changes and modifications are to be understood as included within the scope of the present invention as defined by the appended claims unless they depart therefrom.

What is claimed is:

1. A capsule sealing apparatus which comprises, in combination:

a rectifying means including a rotary drum having its outer peripheral surface formed with at least one circumferential row of circumferentially equally spaced recesses for the support of closed capsules therein, said rectifying means also including a rectifying member for rectifying the closed capsules, received in and transported by said rotary drum towards a transfer station, so as to assume a predetermined posture;

a conveyance means including a generally endless slat having at least one row of oblong openings spaced equally from each other over the entire circumference thereof, and back-up members for supporting the capsules, which have been transferred onto and received in the oblong openings in the slat, from below;

a liquid binder applying means disposed on the path of movement of the closed capsules being transported by the slat for applying a liquid binder to the circumference of each of the closed capsules, said applying means comprising a bath for accommodating a predetermined quantity of liquid binder and an applicator wheel supported for rotation with a portion thereof immersed in the liquid binder within the bath, said applicator wheel as it rotates being operable to apply the liquid binder to the circumference of each of the closed capsules;

a positioning means for bringing each of the capsules being transported by the slat, into alignment with the applicator wheel;

a guide means including at least one pair of arcuate guide members rigidly mounted on the back-up members at a location adjacent the applicator wheel, said arcuate guide members being curved to follow the curvature of the applicator wheel such that, during the transportation of the closed capsules past the liquid binder applying means, each of said closed capsules is caused to ride over the arcuate guide members while rolling a number of revolutions about their own longitudinal axis, said liquid binder being applied from the applicator wheel while each capsule undergoes the rolling motion in contact with the applicator wheel; and a drying means for drying the liquid binder which has been applied to each of the closed capsules to provide a completely sealed capsule.

2. An apparatus as claimed in claim 1, wherein said positioning means comprises at least one stopper bar adjustably mounted on the back-up member at a location adjacent the liquid binder applying means for movement in a direction perpendicular to the direction of movement of the slat.

3. An apparatus as claimed in claim 2, wherein each of the oblong openings defined in the slat has its longitudinal axis inclined at a predetermined angle relative to the imaginary line perpendicular to the direction of movement of the slat.

4. An apparatus as claimed in claim 1, further comprising one or both of a printing roll for printing indicia on each of the capsules and an inspecting device for inspecting each of the capsules being transported, said one or both of the printing roll and the inspecting device being installed at a location downstream of the binder applying means with respect to the direction of movement of the slat.

5. An apparatus as claimed in claim 2, further comprising one or both of a printing roll for printing indicia on each of the capsules and an inspecting device for inspecting each of the capsules being transported, said one or both of the printing roll and the inspecting device being installed at a location downstream of the binder applying means with respect to the direction of movement of the slat.

6. An apparatus as claimed in claim 3, further comprising one or both of a printing roll for printing indicia on each of the capsules and an inspecting device for inspecting each of the capsules being transported, said one or both of the printing roll and the inspecting device being installed at a location downstream of the binder applying means with respect to the direction of movement of the slat.

* * * * *